US005537848A

United States Patent [19]

Grzanka et al.

[11] Patent Number: 5,537,848

[45] Date of Patent: Jul. 23, 1996

[54] DEADBOLT LOCKING SYSTEM

[75] Inventors: Thomas Grzanka, Lexington; John I. Moceanu, Sterling Heights; Lloyd W. Rogers, Jr., Shelby Township; Gary D. Bree, Clarkston, all of Mich.

[73] Assignee: General Motors Corporation, Detroit, Mich.

[21] Appl. No.: 266,088

[22] Filed: Jun. 27, 1994

[51] Int. Cl.[6] ..... E05B 47/00

[52] U.S. Cl. ..... 70/279; 70/283; 292/201; 292/336.3

[58] Field of Search ..... 70/264, 277, 279–283; 292/201, 336.3

[56] References Cited

U.S. PATENT DOCUMENTS

| | | | |
|---|---|---|---|
| 3,751,088 | 8/1973 | Schlage et al. | 70/279 X |
| 4,315,649 | 2/1982 | Lutz | 292/201 |
| 4,342,209 | 8/1982 | Kleefeldt | 70/264 |
| 4,364,249 | 12/1982 | Kleefeldt | 70/264 |
| 4,440,006 | 4/1984 | Kleefeldt | 70/264 |
| 4,508,379 | 4/1985 | Mochida | 292/336.3 |
| 4,518,180 | 5/1985 | Kleefeldt et al. | 292/201 |
| 4,519,227 | 5/1985 | Dumbser et al. | 70/237 X |
| 4,727,301 | 2/1988 | Fulks et al. | 318/468 |
| 4,885,922 | 12/1989 | Lutz | 70/264 |
| 4,932,277 | 6/1990 | Beaux | 74/89.15 |
| 4,941,694 | 7/1990 | Bartel et al. | 292/336.3 X |
| 4,974,886 | 12/1990 | Kleefeldt et al. | 292/201 |
| 4,978,154 | 12/1990 | Kleefeldt et al. | 292/201 |
| 5,040,390 | 8/1991 | Mistry et al. | 70/241 |
| 5,052,731 | 10/1991 | Hayakawa et al. | 292/336.3 |
| 5,054,300 | 10/1991 | Nakahara et al. | 70/262 |
| 5,277,461 | 1/1994 | Dzurko et al. | 292/216 |
| 5,438,855 | 8/1995 | Ikeda | 70/279 |

FOREIGN PATENT DOCUMENTS

| | | | |
|---|---|---|---|
| 0647754 | 4/1995 | European Pat. Off. . | |
| 2452563 | 10/1980 | France . | |
| 3625833 | 2/1988 | Germany . | |
| 3812331 | 11/1989 | Germany . | |
| 2167802 | 6/1986 | United Kingdom | 70/276 |

*Primary Examiner*—Lloyd A. Gall
*Attorney, Agent, or Firm*—Jeffrey A. Sedlar

[57] ABSTRACT

A vehicle door latch system including a deadbolt locking mechanism. The deadbolt locking mechanism is disengaged manually from outside the vehicle using the key cylinder. The manual deadbolt disengagement mechanism is effective in disengaging the deadbolt in the event of total vehicle power loss. The deadbolt mechanism includes a power driven rack.

7 Claims, 6 Drawing Sheets

DEADBOLT LOCKING SYSTEM

BACKGROUND OF THE INVENTION

This invention relates to vehicle door latches and more particularly to door latches that include a deadbolt locking mechanism.

Automobiles conventionally include a door latch on each vehicle door to hold the door in a closed position. Each vehicle door latch includes a lock that is commonly actuated from inside the vehicle by a readily accessible door lock button or other manually operable device on the door. The vehicle door locks for the front doors are also conventionally operated from outside the vehicle using a key lock cylinder.

In addition to manual buttons and key cylinders, it is conventional to employ a power actuated lock system as a feature of the latches. The power lock system generally uses an electrically powered actuator associated with each door latch. The actuator is used to move the door lock between its locked and unlocked position. The electric actuators are typically activated by switches accessible from inside the vehicle and switches on the door lock key cylinder.

One feature of conventional manual and power door lock systems is that they can be actuated from inside the vehicle by a readily accessible manually operable button. As a consequence, although a door is left in a locked condition, access to the inside door lock button permits the unwanted unlocking of a vehicle door latch. Due to this condition unwanted access to the vehicle can occur through a partially open window, a broken window or by circumventing the window to access the door lock button.

To deter unwanted access to vehicles through the means described above, it is known to include a deadbolt locking feature with a vehicle latch. The deadbolt locking feature disables the inside door lock button from unlocking the lock mechanism and therefore, prevents unwanted opening of the doors. When a vehicle is in the deadbolt state all the doors are locked and cannot be unlocked manually using the inside door lock button.

Conventional deadbolt locking systems include a mechanical deadbolt system on the driver door and power systems on the remaining doors. In case of power failure, the mechanical system still works. A problem with this system is that deadbolt can only be engaged/disengaged from one side of the vehicle. For the deadbolt to be engaged/disengaged from either front door or by remote, all doors must have power deadbolt locking systems.

SUMMARY OF THE INVENTION

The general object of the invention is to provide an effective deadbolt locking system for a vehicle's door latch that can include a manual override feature. In accordance with the present invention the vehicle door latch has a power driven lock actuator that includes a deadbolt locking feature.

The invention preferably incorporates a manual override device in the deadbolt locking system operable to effect disengagement of the deadbolt in the event of the vehicle power losses. An advantage of the present deadbolt locking system is that it may be disengaged from either the driver or passenger side of the vehicle or by remote when power is available.

DETAILED DESCRIPTION OF THE PRESENTLY PREFERRED EMBODIMENT

Figure 1:
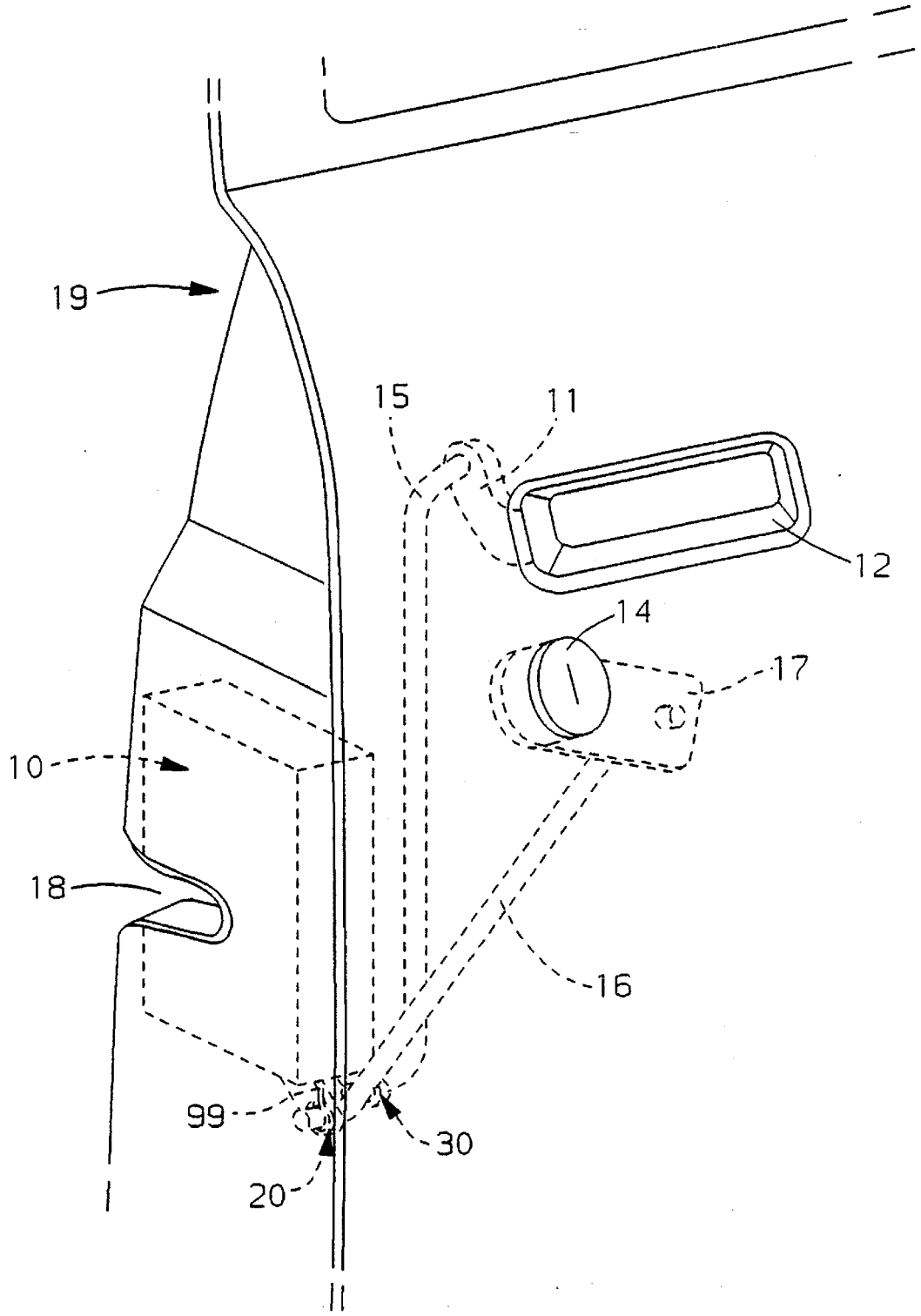
FIG. 1 is a partial perspective view of a vehicle door showing the latch assembly.

Referring to FIG. 1 a vehicle door 19 is partially shown. Positioned in the door 19 is latch 10. Latch 10 includes outside lock operating lever 20 and outside latch operating lever 30. Door 19 also includes outside handle 12. Connected to outside handle 12 is lever 11. Connected between outside latch operating lever 30 and lever 11 is outside handle rod 15. The combination of outside handle 12, lever 11, outside handle rod 15 and outside latch operating lever 30 permits the unlatching of latch 10 through the use of outside handle 12. Outside handle 12 is normally in a position corresponding to a latched condition of latch 10. Outside handle 12 is moveable to a position corresponding with an unlatched condition of latch 10 to open door 19.

Door 19 also includes interior latch and lock operating systems, (not illustrated), accessible from inside the vehicle. These systems rotate inside latch operating lever 56 and inside lock operating lever 80, (illustrated in FIG. 2). Inside operating levers 56 and 80 are disposed perpendicular to the outside operating levers 20 and 30.

Door 19 also includes key cylinder 14. Key cylinder 14 is operable through use of a unique key (not shown). Key cylinder 14 includes arm 17. Linking outside lock operating lever 20 and arm 17 is outside lock rod 16. The combination of key cylinder 14, arm 17, outside lock rod 16 and outside lock operating lever 20 permits the manual locking and unlocking of latch 10 through the use of key cylinder 14.

Figure 2:
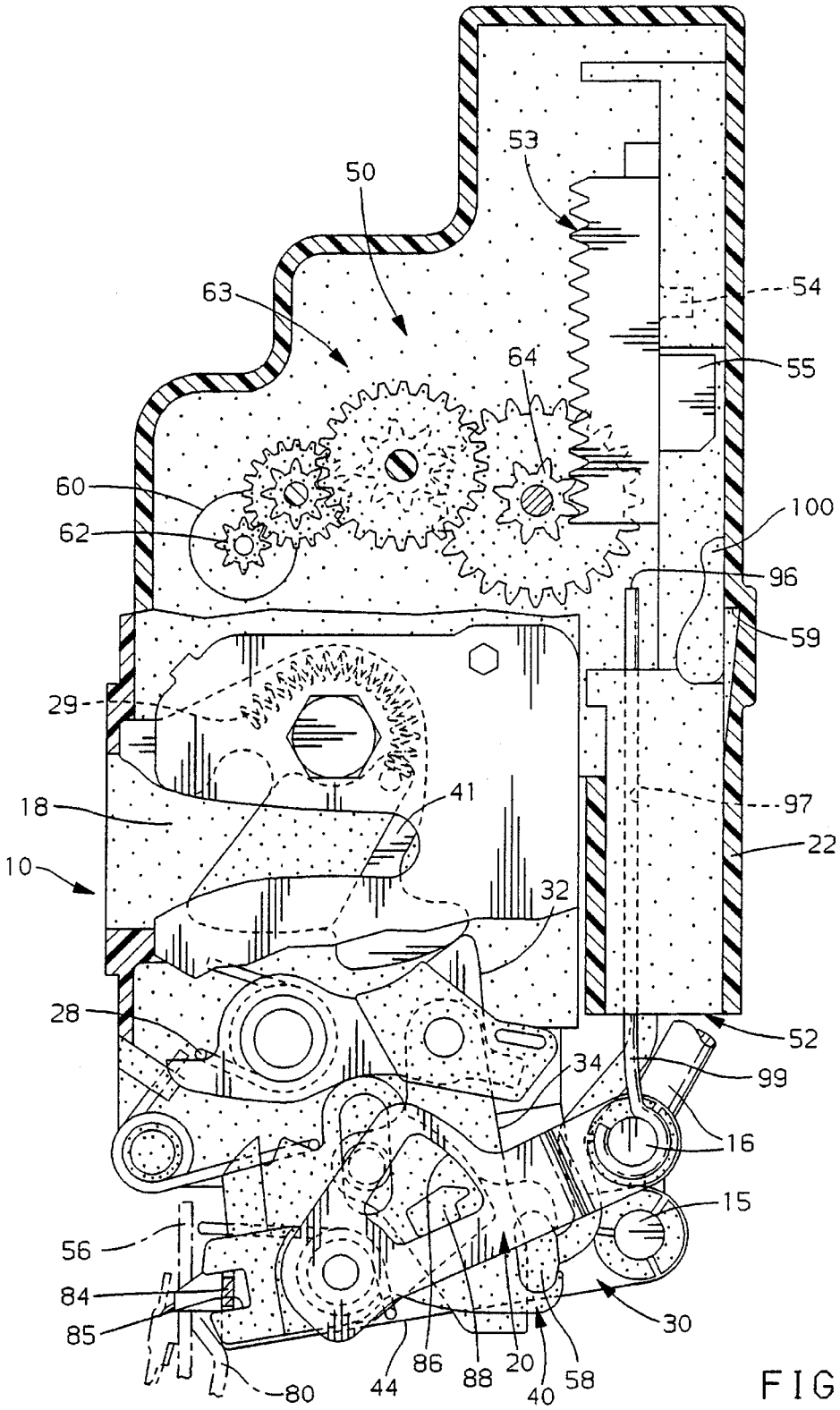
FIG. 2 is a cross-sectional view of a vehicle door latch according to the present invention.
Figure 3:
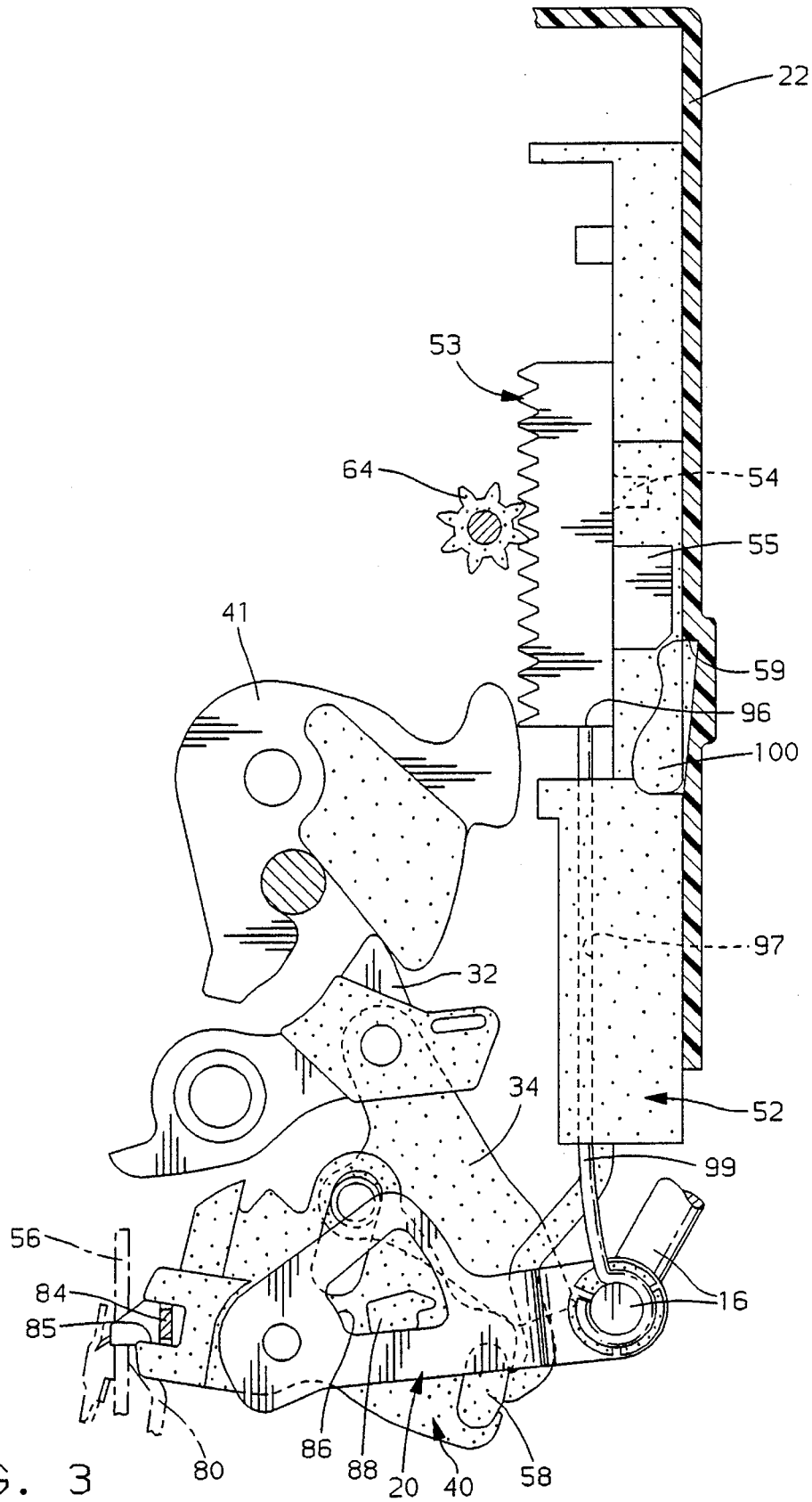
FIG. 3 is an assembly drawing of the locking mechanism of the latch.
Figure 4:
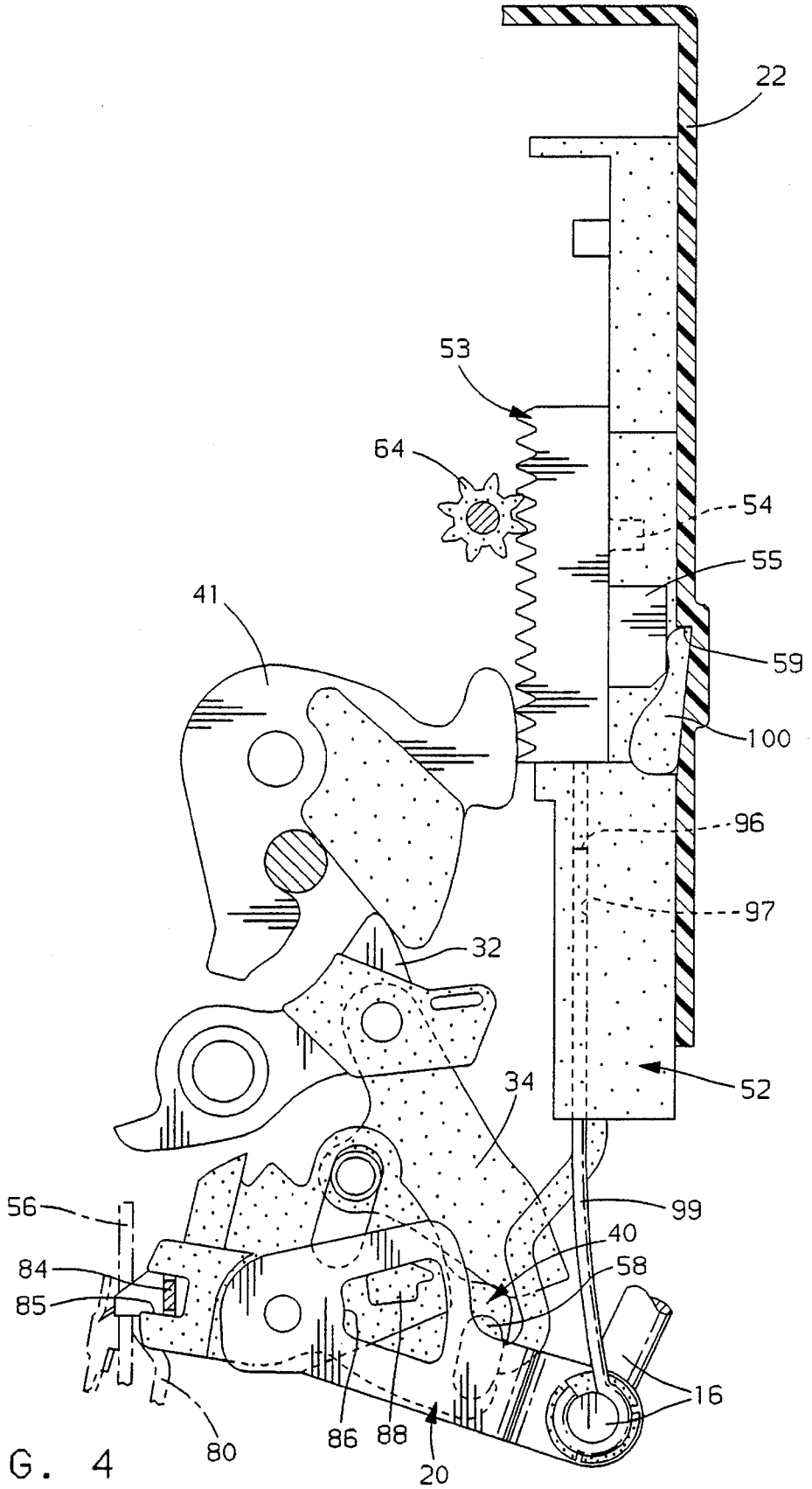
FIG. 4 is an assembly drawing of the locking mechanism of the latch.

Key cylinder 14 is moveable to a position corresponding to an unlocked condition of latch 10. When latch 10 is in the unlocked condition as shown in FIG. 2, outside handle 12 is effective to open the door 19. Key cylinder 14 is also moveable to a position corresponding to a locked condition of latch 10. When latch 10 is in the locked condition as shown in FIG. 3, outside handle 12 is ineffective in opening the door 19. Key cylinder 14 is also positionable to engage and disengage a deadbolt locking system as described below.

Door 19 and latch 10 cooperate in exhibiting cavity 18. Cavity 18 permits the engagement between latch 10 and a striker, (not illustrated), positioned around the vehicle's door frame, (not illustrated), to hold door 19 in a closed position.

Referring to FIG. 2, the internal components of latch 10 are illustrated in an unlocked and undeadbolted condition. This type of latch assembly is described in U.S. Pat. No. 5,277,461 which issued Jan. 11, 1994 and is commonly assigned. The vehicle door latch 10 is carried as an assembly by plastic housing 22.

The latching mechanism of latch 10 includes fork-bolt lever 41 and cooperating detent lever 32 both of which are pivotally mounted. Fork-bolt lever 41 is biased clockwise by coil spring 29. Detent lever 32 is biased counterclockwise by spring 28 into engagement with fork-bolt lever 41. The detent lever 32 engages fork-bolt lever 41 in its unlatched position as shown in FIG. 2 and engages and holds fork-bolt lever 41 in intermediate and latched positions against the bias of spring 29.

Additionally, the latching mechanism includes an intermittent lever 34 for operating detent lever 32 and a transfer lever 44 for operating intermittent lever 34. Locking lever 40 pivots the intermittent lever 34 into and out of engagement with transfer lever 44 thereby controlling operation of the latch 10 by "locking" and "unlocking" the system.

Latch 10 includes outside latch operating lever 30, which is connected to outside handle 12 by handle rod 15, as shown in FIG. 1. The outside latch operating lever 30 engages transfer lever 44 so that transfer lever 44 is rotated clockwise when outside latch operating lever 30 is manually actuated. The transfer lever 44 and outside latch operating lever 30 are biased counterclockwise to a normal position.

Inside latch operating lever 56 also engages transfer lever 44. The inside latch operating lever 56 is connected by suitable linkage, (not illustrated), to an inside door handle, (not shown), for rotation thereby, so that transfer lever 44 is rotated clockwise when the inside door handle is manually actuated.

Transfer lever 44 engages both inside latch operating lever 56 and outside latch operating lever 30. Transfer lever 44 also selectively engages intermittent lever 34 so that the intermittent lever 34 is moved downward when a transfer lever 44 is rotated clockwise by either of the inside 56, or outside 30, latch operating levers thereby operating the latch.

The latching mechanism operates as follows. When the door latch 10 is in an unlatched and unlocked condition as shown in FIG. 2 the fork-bolt lever 41 is poised to receive a conventional striker, (not shown), that projects into cavity 18. The entering striker rotates the fork-bolt lever 41 counterclockwise against the bias of spring 29 until the fork-bolt lever 41 is rotated to a full latched position. When fork-bolt lever 41 is in the full latched position it is engaged by detent lever 32 and held in the latched position as shown in FIG. 3.

The vehicle door latch 10 is unlatched so that the vehicle door 19 can be opened by operating either of the inside or outside door handles to rotate the transfer lever 44 clockwise. As transfer lever 44 rotates clockwise, intermittent lever 34 is pulled down from the latched positioned of FIG. 3 to an unlatched position, (shown in FIG. 2). As the intermittent lever 34 is pulled down it rotates the detent lever 32 clockwise. Fork-bolt lever 41 is then free to rotate clockwise under the bias of spring 29 from the latched position to the unlatched position as the striker is pulled out of cavity 18 when the vehicle door 19 is opened.

The vehicle door latch 10 includes a lock mechanism for disabling the latching mechanism so that operation of either the inside door handle or the outside door handle is ineffective in unlatching the latch 10. The lock mechanism is more clearly illustrated in FIG. 3. Locking lever 40 is pivotally mounted and engages intermittent lever 34. Locking lever 40 is biased to the unlocked position as shown in FIG. 2 and pivots clockwise from this position to a locked position as shown in FIG. 3.

The locking mechanism also includes inside lock operating lever 80 and outside lock operating lever 20, both for pivoting the locking lever 40 between locked and unlocked positions. The inside lock operating lever 80 includes tab 84 that engages slot 85 in one end of locking lever 40. The outside lock operating lever 20 has a sector-shaped cutout 86 that receives an integral projection 88 of the locking lever 40. This forms a lost motion connection between the outside lock operating lever 20 and the locking lever 40 so that the key cylinder 14 (shown in FIG. 1) can be returned to a neutral position after the locking lever 40 is rotated either to the locked or unlocked position.

The lock mechanism operates as follows. When the vehicle door latch 10 is in a latched condition as shown in FIG. 3, the lock mechanism is actuated by rotating the locking lever 40 clockwise from the unlocked position of FIG. 2 to the locked position of FIG. 3. This can be accomplished through rotation of the inside lock operating lever 80 by an inside door lock button (not illustrated) or similar device, or by the rotation of the outside lock operating lever 20 by turning the key, (not illustrated), in the key lock cylinder 14.

Clockwise rotation of locking lever 40 also rotates intermittent lever 34 counterclockwise. Intermittent lever 34 is rotated counterclockwise from the unlocked position shown in FIG. 2 to a locked position shown in FIG. 3. This rotation disengages intermittent lever 34 from the transfer lever 44. As a result, when the door handles are operated to rotate either of inside 56, or outside 30 latch operating levers and transfer lever 44 to the unlatched position, no motion is transferred to intermittent lever 34. In other words, when the latch is in the locked condition, the transfer lever 44 simply free wheels so that operation of the door handles is ineffective in opening the latch 10.

The lock mechanism is unlocked by rotating locking lever 40 counterclockwise to the unlocked position shown in FIG. 2. This re-engages transfer lever 44 with intermittent lever 34.

Referring to FIG. 2, also illustrated is a power locking actuator assembly 50. Actuator arm 52 includes head 58 that engages locking lever 40. Therefore, actuator arm 52 moves between positions corresponding to a locked position of locking lever 40 as shown in FIG. 3 and an unlocked position of locking lever 40 as shown in FIG. 2. Powered movement of actuator arm 52 is also effective in repositioning locking lever 40 between the unlocked and locked positions.

Power is supplied to actuator 50 by motor 60, which includes output gear 62. Motor 60 is activated by an electric control system that includes a switch, (not illustrated), responsive to turning of a key in key cylinder 14 in a predetermined manner and to a switch, (not illustrated), accessible from the vehicle's interior. Actuator 50 also includes gear train 63 to transfer power from output gear 62 to rack pinion 64. Rack pinion 64 engages rack 53.

Rack 53 includes molded boss 54. Molded boss 54 engages actuator arm 52 in aperture 51, as better illustrated in FIG. 8. Molded boss 54 of rack 53 is driven through aperture 51 between bumper 72 and 73. However, as boss 54 moves relative to the actuator arm 52 it engages detents 71. Therefore, when detents 71 are engaged by driven boss 54, the actuator arm moves in concert with rack 53 relative to housing 22 until a stop is met at which point, if rack 53 continues to be driven by motor 60, boss 54 is driven through detents 71 and again will be driven relative to actuator arm 52.

The lock actuator mechanism operates as follows. Actuation between the unlocked position, shown in FIGS. 2 and 5, and the locked position, shown in FIGS. 3 and 6, is initiated by a switch (not illustrated) associated with an interior door lock button or a switch (not illustrated) associated with the key cylinder 14. Actuation occurs when the interior door lock switch is moved to a lock or unlock position or when the key cylinder is rotated to a lock or unlock position.

A signal from the movement of either switch to the lock position activates the electrical control system to energize actuator motor 60. Actuator motor 60 drives gear train 63 which in turn drives the rack 53 from unlocked to locked positions. During rack 53 travel, the molded boss 54 moves relative to detents 71 on the actuator arm 52. At a selected point the molded boss 54 contacts the detents 71. At this point the actuator arm 52 is pushed by molded boss 54 and in turn actuator arm 52 drives locking lever 40 on the latch 10. At the end of travel of the locking lever 40 the actuator arm 52 bottoms out. The rack 53 continues to travel and the force applied by the motor 60 drives the molded boss 54 through detents 71.

Figure 8:
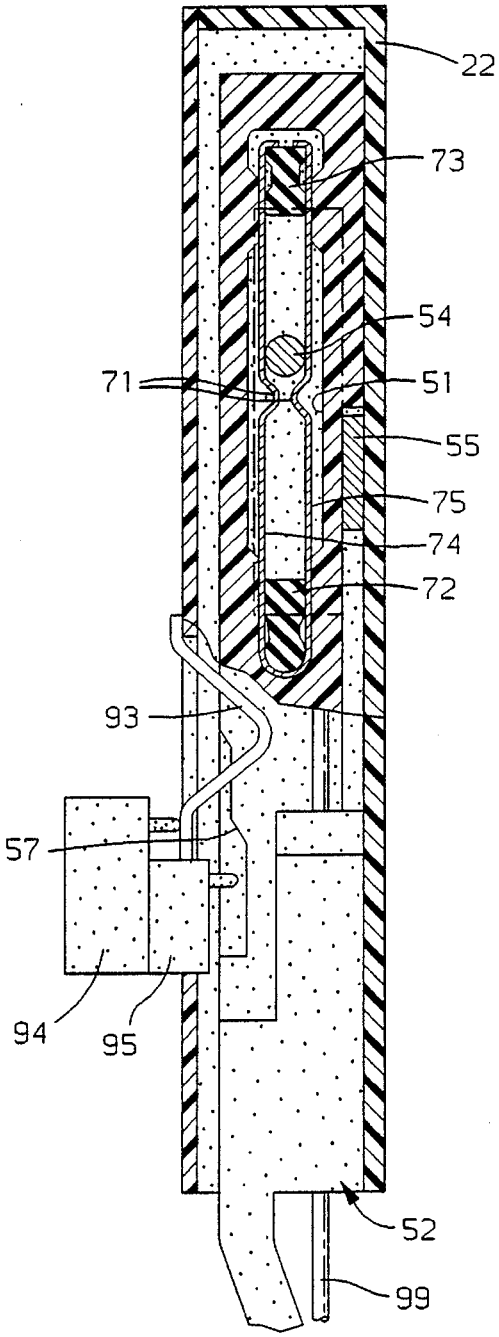
FIG. 8 is a partial cross-sectional view of a latch according to the present invention.

As shown in FIG. 8, the detents are part of opposed beams 74 and 75, which are fixedly located in aperture 51 of actuator arm 52. Beams 74 and 75 flex apart as the molded boss 54 passes through detent 71. The force required to drive molded boss 54 through detent 71 is greater than the force required to drive the total locking system and rotate locking lever 40.

At the mid-point in the detents 71 the rack 53 triggers a snap-action switch 94, (illustrated in FIG. 8), by engaging arm 93. Snap-action switch 94 provides dynamic braking to the motor 60. The rack 53 travels an additional 3 millimeters and stops after dynamic braking begins. At this point the actuator 50 has been driven to the locked position as shown in FIG. 6. With the actuator arm 52 in this position, locking lever 40 is in the locked position as shown in FIG. 3.

When the actuator arm 52 is moved to the locked position as shown in FIG. 6, step 57 engages central lock switch 95, (see FIG. 8). Central lock switch 95 signals the electrical control system, (not illustrated), that the latch 10 is in a locked condition. Latch 10 is unlocked through movement of the interior door switch, interior door lock button or key cylinder to the unlock position.

When in the full locked position, latch 10 can be deadbolted. To effect the deadbolt function, actuator arm 52 includes deadbolt lever 100. Deadbolt lever 100 moves with actuator arm 52 relative to housing 22 between the unlocked position shown in FIG. 5 and the locked position shown in FIG. 6. When the actuator arm 52 is moved to a full locked position as shown in FIG. 6, deadbolt lever 100 is adjacent to deadbolt aperture 59 in plastic housing 22.

Figure 7:
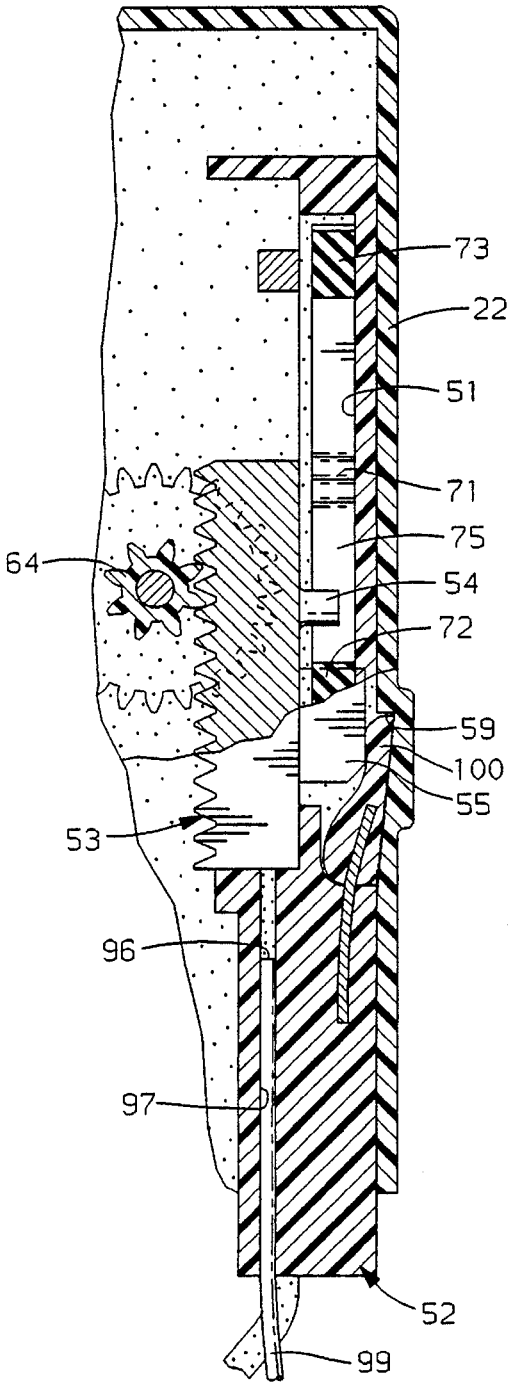
FIG. 7 is a partial cross-sectional view of the latch actuator.

Deadbolt activation drives rack 53 to the point where cam 55 engages deadbolt lever 100 forcing it into deadbolt aperture 59 as shown in FIG. 7. The position shown in FIG. 7 corresponds to a locked and deadbolted condition of the latch 10. When in this position the door 19 cannot be opened by either the inside or outside handle and the interior door lock button is ineffective in unlocking the latch 10.

Figure 5:
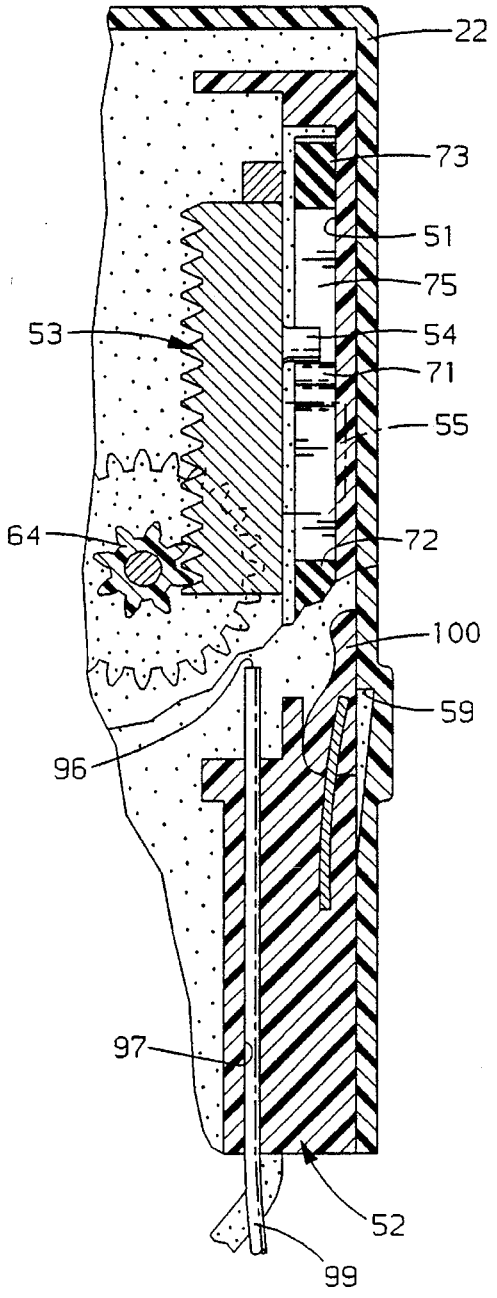
FIG. 5 is a partial cross-sectional view of the latch actuator.
Figure 6:
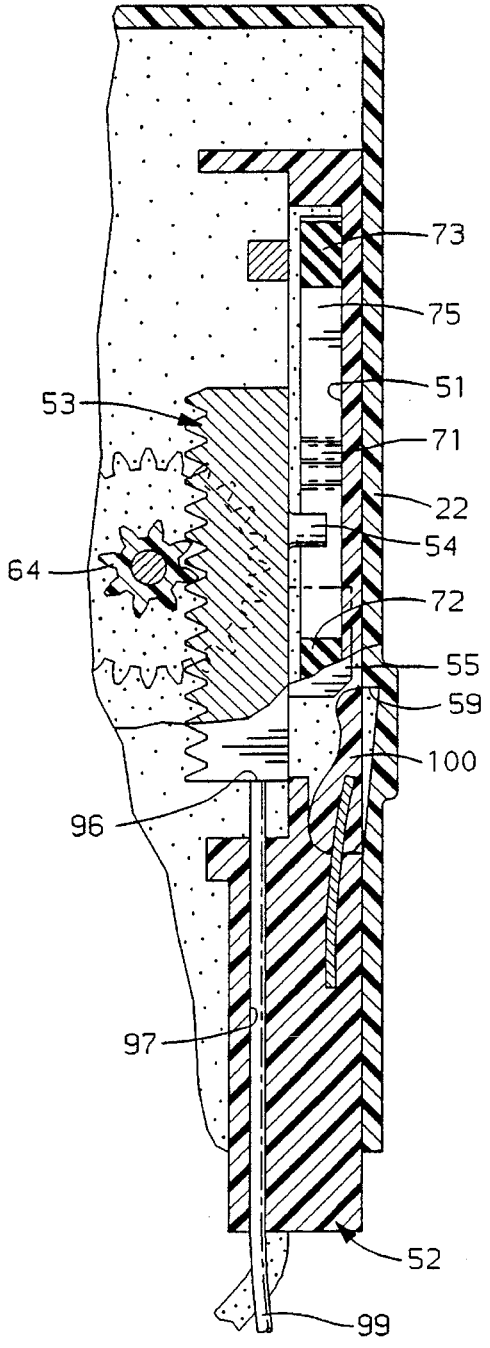
FIG. 6 is a partial cross-sectional view of the latch actuator.

FIGS. 5, 6 and 7 illustrate, progressively, actuator positions corresponding to an unlocked and undeadbolted state, (FIG. 5), a locked and undeadbolted state, (FIG. 6), and a locked and deadbolted state, (FIG. 7).

The deadbolt mechanism is engaged or disengaged from outside the vehicle using the key cylinder 14. To engage the deadbolt, key cylinder 14 is rotated 90 degrees from vertical to horizontal switching the system to deadbolt. At this point the key is returned to vertical and removed from key cylinder 14.

The deadbolt signal from the key cylinder switch activates the electrical control system to energize actuator motor 60 which drives rack 53 eleven millimeters to the deadbolt position shown in FIG. 7. During this cycle cam 55, of rack 53, engages deadbolt lever 100 forcing it into deadbolt aperture 59. With deadbolt lever 100 positioned in deadbolt aperture 59, actuator arm 52 is secured in position and the latch 10 is in a deadbolt condition. During the engagement cycle of the deadbolt, motor 60, gear train 63, rack 53 and deadbolt lever 100 are in motion, actuator arm 52 is stationary.

To disengage the deadbolt, key cylinder 14 is rotated from vertical to approximately 30 degrees corresponding to an unlocked position to generate an unlock signal and is then rotated back to vertical. An unlock signal from the key cylinder switch activates the electrical control system to energize actuator motor 60 which drives rack 53 twenty-eight millimeters from the deadbolt position of FIG. 7 to the unlocked position of FIG. 5.

During this cycle cam 55 disengages from deadbolt lever 100 and deadbolt lever 100 pivots back into its normal position out of deadbolt aperture 59 as shown in FIG. 6. When deadbolt lever 100 exits deadbolt aperture 59 the system is undeadbolted. Rack 53 is then driven relative to actuator arm 52 until molded boss 54 engages detents 71. After engagement, the travel of rack 53 drives actuator arm 52 into an unlocked position which in turn moves lock lever 40 to the unlocked position.

When locking lever 40 reaches its end of travel, actuator arm 52 bottoms out at which point rack 53 moves relative to actuator arm 52. Molded boss 54 is driven through detents 71 which flex due to the force applied by the rack 53. The rack 53 travels an additional five millimeters past detents 71 and stops. At this point the latch 10 is undeadbolted and unlocked, with the locking mechanism positioned as shown in FIG. 2.

As described above the deadbolt engagement and disengagement system is power driven by means of motor 60. In the event of power failure due to conditions such as a dead vehicle battery, (not illustrated), motor 60 will be ineffective in moving rack 53 and therefore, ineffective in engaging or disengaging the deadbolt.

To disengage the deadbolt in the event of a vehicle power loss, latch 10 includes a deadbolt manual override system. Manual override rod 99 is connected to outside lock rod 16 at outside lock operating lever 20, as shown in FIG. 2, and moves in concert with outside lock operating lever 20. Manual override rod 99 extends through, and is moveable relative to, opening 97 in actuator arm 52 and terminates at end 96. End 96 is adapted to engage rack 53.

To manually disengage the deadbolt in the event of vehicle power failure, this invention preferably includes a manual override feature. To manually override the deadbolt, key cylinder 14 is rotated approximately 45 degrees from vertical to unlock position and rotated back to vertical. As the key cylinder 14 is rotated to the unlocked position manual override rod 99 pushes against rack 53. When rack 53 is pushed, the force applied thereto overcomes the friction in gear train 63 and motor 60, moving rack 53. As rack 53 moves, the cam 55 disengages from deadbolt lever 100. Deadbolt lever 100 flexes out of deadbolt aperture 59 when cam 55 moves away and actuator arm 52 is now movable.

As rack 53 continues to move under the applied force, molded boss 54 comes in contact with detents 71 and the sector shaped cut out 86 of outside lock operating lever 20 engages integral projection 88 of locking lever 40, the actuator arm 52 and locking lever 40 are engaged and driven to an unlocked position. The vehicle latch 10 is now undeadbolted and unlocked. The lost motion permitted between outside lock operating lever 20 and locking lever 40 provided by the sector-shaped cutout 86 and the integral projection 88, permits the movement of outside lock operating lever 20, prior to movement of actuator arm 52, to disengage cam 55 from deadbolt lever 100 and to manually undeadbolt the system.

What is claimed is:

1. A deadbolt locking system for a vehicle door comprising:

a latch assembly including a locking lever that is rotatable between a locked and an unlocked position;

an outside lock operating lever engaging the locking lever and capable of rotating the locking lever between the locked and the unlocked positions;

a power locking actuator assembly including a housing, an actuator arm that engages the locking lever and a slidable rack that engages the actuator arm so that the power locking actuator assembly is capable of rotating the locking lever between the locked and unlocked positions;

a deadbolt lever carried by the actuator arm and capable of preventing movement of the actuator arm when the locking lever is in the locked position through selective engagement with the housing;

a lock rod connected to the outside lock operating lever operated by a rotatable key cylinder enabling locking and unlocking of the latch assembly manually, from outside the vehicle;

a deadbolt override link connected to the lock rod and engageable with the rack and when the deadbolt lever is engaged with the housing, the deadbolt override link being capable of sliding the rack in response to manual rotation of the key cylinder to disengage the deadbolt lever permitting movement of the actuator arm.

2. A deadbolt locking system according to claim 1 wherein the actuator arm includes a pair of opposed beams forming a detent and the rack includes a boss that is received between the pair of opposed beams and is slidable through the detent.

3. A deadbolt locking system according to claim 2 wherein a first force is required for the power locking actuator assembly to rotate the locking lever, wherein a second force is required to slide the boss through the detent and wherein the second force is greater than the first force.

4. A deadbolt locking system having a latch assembly and a rotatable key cylinder for locking and unlocking the latch assembly, the deadbolt locking system comprising:

a housing supporting the latch assembly having a deadbolt aperture;

a locking lever movable between locked and unlocked positions carried in the latch assembly;

a lock rod connected between the key cylinder and the latch assembly capable of effecting movement of the locking lever between the locked and unlocked positions through rotation of the key cylinder;

a power locking actuator capable of moving the locking lever between the locked and the unlocked positions including a slidable actuator arm that engages the locking lever, a rack having a boss engaging the actuator arm and a cam and including a deadbolt lever moveable into the deadbolt aperture by the cam to inhibit sliding movement of the actuator arm by locking the actuator arm in position; and a deadbolt override link connected to the lock rod and engageable with the rack wherein the deadbolt override link is for manually disengaging the deadbolt locking system by repositioning the rack, wherein repositioning of the rack disengages the cam from the deadbolt lever and permits movement of the actuator arm to an undeadbolted and unlocked position by the power locking actuator in response to rotation of the key cylinder.

5. A vehicle door latch with an outside key cylinder linked to the door latch comprising:

a housing;

a locking lever carried by the housing positionable between a locked and an unlocked position to lock and unlock the door latch;

an actuator arm integral with the latch and connected to the locking lever including a series of detents and a deadbolt lever;

a power driven rack including a boss operatively engaging the series of detents to effect selected linear positioning of the actuator arm and including a cam operatively engaging the deadbolt lever to selectively engage the deadbolt lever with the housing;

a motor carried by the housing and operable to drive the rack; and an electrical control system activated by the key cylinder to automatically operate the motor to effect movement of the rack to engage and disengage the deadbolt lever.

6. A vehicle door latch with an outside key cylinder linked to the door latch comprising:

a housing;

a locking lever carried by the housing positionable between a locked and an unlocked position to lock and unlock the door latch;

an actuator arm integral with the latch and connected to the locking lever including a series of detents and a deadbolt lever;

a power driven rack including a boss operatively engaging the series of detents to effect selected linear positioning of the actuator arm and including a cam operatively engaging the deadbolt lever to selectively engage the deadbolt lever with the housing;

an electrical control system activated by the key cylinder to automatically effect movement of the rack to engage and disengage the deadbolt lever; and a deadbolt override link operated by the key cylinder and selectively engaging the rack to manually move the rack to disengage the deadbolt lever regardless of the availability of vehicle electrical power.

7. A deadbolt locking system for a vehicle door comprising:

a latch assembly having a locking lever movable between a locked and an unlocked position, an actuator arm connected to the locking lever and capable of moving the locking lever between the locked and the unlocked positions, a power driven rack engaging the actuator arm and capable of moving the actuator arm and a deadbolt lever carried by the actuator arm and selectively engageable by the rack to lock the actuator arm in a deadbolt position corresponding to the locked position of the locking lever;

a lock rod engaging the latch assembly to move the locking lever between the locked and the unlocked positions; and a deadbolt override link connected to the lock rod and engageable with the rack wherein the lock rod is movable to a deadbolt disengage position where the deadbolt override link moves the rack to disengage from the deadbolt lever.

* * * * *